US010859217B2

(12) United States Patent
Liu et al.

(10) Patent No.: US 10,859,217 B2
(45) Date of Patent: Dec. 8, 2020

(54) LIGHT SOURCE APPARATUS AND METHOD OF MANUFACTURING THE SAME

(71) Applicant: OPPLE LIGHTING CO., LTD., Shanghai (CN)

(72) Inventors: Chaobo Liu, Shanghai (CN); Hongbo Wang, Shanghai (CN); Xiaowei Xu, Shanghai (CN); Xuejun Feng, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 15/855,541

(22) Filed: Dec. 27, 2017

(65) Prior Publication Data

US 2018/0119937 A1 May 3, 2018

Related U.S. Application Data

(63) Continuation of application No. PCT/CN2016/112700, filed on Dec. 28, 2016.

(30) Foreign Application Priority Data

Dec. 29, 2015 (CN) ..... 2015 1 1017160
Dec. 29, 2015 (CN) ..... 2015 2 1126851 U

(51) Int. Cl.
*F21S 2/00* (2016.01)
*F21V 5/00* (2018.01)
(Continued)

(52) U.S. Cl.
CPC ..... *F21S 2/005* (2013.01); *F21V 3/02* (2013.01); *F21V 5/00* (2013.01); *F21V 5/007* (2013.01);
(Continued)

(58) Field of Classification Search
CPC ..... F21Y 2105/18; F21Y 2115/10; F21Y 2103/33; F21V 5/043
See application file for complete search history.

(56) References Cited

U.S. PATENT DOCUMENTS 4,677,533 A * 6/1987 McDermott ..... F21S 10/02 362/240
5,893,626 A * 4/1999 Poling ..... B62J 6/04 362/231
(Continued)

FOREIGN PATENT DOCUMENTS

CN 1367541 A 9/2002
CN 101169232 A 4/2008
(Continued)

OTHER PUBLICATIONS

International Search Report in connection with PCT/CN2016/112700, dated Apr. 12, 2017, 12 pages.
(Continued)

*Primary Examiner* — Alexander K Garlen
(74) *Attorney, Agent, or Firm* — Arch & Lake LLP

(57) ABSTRACT

Examples of the present disclosure disclose a light source apparatus and a method of manufacturing the light source apparatus. The light source apparatus includes a luminescent component having a substrate and at least two luminescent units disposed on the substrate, where the at least two luminescent units is arranged along a circular ring; and a light distribution component including an optical element provided with an annular lens or a transparent mask and a mounting part encircling the annular lens or the transparent mask and being connected with the optical element and the substrate, where the lens or the transparent mask receive emergent light of the at least two luminescent units and emitting the light after light distribution, and the mounting
(Continued)

part is bonded to the substrate and is configured to fix the optical element above the at least two luminescent units.

14 Claims, 3 Drawing Sheets

(51) Int. Cl.

| | |
|---|---|
| ***F21V 3/02*** | (2006.01) |
| ***F21V 15/01*** | (2006.01) |
| ***F21V 23/00*** | (2015.01) |
| ***F21V 23/02*** | (2006.01) |
| ***F21Y 115/10*** | (2016.01) |
| ***F21Y 105/18*** | (2016.01) |

(52) U.S. Cl.
CPC ..... *F21V 15/01* (2013.01); *F21V 23/005* (2013.01); *F21V 23/02* (2013.01); *F21Y 2105/18* (2016.08); *F21Y 2115/10* (2016.08)

(56) References Cited

U.S. PATENT DOCUMENTS

| | | | | |
|---|---|---|---|---|
| 5,984,494 | A * | 11/1999 | Chapman | B64D 47/04 362/240 |
| 6,033,087 | A * | 3/2000 | Shozo | G01N 21/8806 362/19 |
| 6,992,333 | B2 | 1/2006 | Nagai et al. | |
| 9,408,282 | B1 * | 8/2016 | Springer | H05B 37/0272 |
| 2006/0181416 | A1 * | 8/2006 | Chen | F21V 23/0471 340/545.2 |
| 2009/0101922 | A1 * | 4/2009 | Lin | F21K 9/00 257/89 |
| 2009/0207586 | A1 | 8/2009 | Arai | |
| 2009/0257234 | A1 * | 10/2009 | Zheng | F21S 6/005 362/373 |
| 2010/0219758 | A1 * | 9/2010 | Melzner | F21K 9/00 315/113 |
| 2010/0315815 | A1 | 12/2010 | Lin et al. | |
| 2011/0069485 | A1 | 3/2011 | Jacobi | |
| 2011/0170294 | A1 * | 7/2011 | Mier-Langner | F21S 8/02 362/294 |
| 2011/0222307 | A1 * | 9/2011 | Kong | F21K 9/00 362/554 |
| 2012/0236532 | A1 | 9/2012 | Amano et al. | |
| 2013/0107517 | A1 * | 5/2013 | Shih | F21V 3/00 362/235 |
| 2013/0170207 | A1 | 7/2013 | Garcia | |
| 2013/0242566 | A1 * | 9/2013 | Kim | F21V 7/00 362/308 |
| 2014/0061689 | A1 * | 3/2014 | Seibel | H01L 25/0753 257/89 |
| 2014/0078766 | A1 * | 3/2014 | Giametta | B60Q 1/0052 362/516 |
| 2014/0168995 | A1 * | 6/2014 | Chen | F21V 5/043 362/311.02 |
| 2015/0212263 | A1 * | 7/2015 | Tzeng | F21V 17/12 362/555 |
| 2015/0243143 | A1 * | 8/2015 | Chen | G08B 13/19619 348/151 |
| 2015/0285465 | A1 * | 10/2015 | Andrisin, III | F21V 5/00 362/84 |
| 2015/0377479 | A1 * | 12/2015 | Pescod | H01Q 1/007 362/85 |
| 2016/0003444 | A1 * | 1/2016 | Dennis | F21V 7/06 362/235 |

FOREIGN PATENT DOCUMENTS

| | | | |
|---|---|---|---|
| CN | 201359210 | Y | 12/2009 |
| CN | 201787405 | | 4/2011 |
| CN | 102679208 | A | 9/2012 |
| CN | 102809118 | A | 12/2012 |
| CN | 202708867 | U | 1/2013 |
| CN | 105465669 | A | 4/2016 |
| CN | 205261289 | U | 5/2016 |
| DE | 102014205891 | | 10/2015 |
| EP | 2206945 | | 7/2010 |
| EP | 2494266 | | 9/2012 |
| EP | 2518395 | | 10/2012 |
| WO | 2010101405 | | 9/2010 |

OTHER PUBLICATIONS

First Chinese Office Action issued in CN201511017160.8, dated Aug. 31, 2017, 12 pages.
Second Chinese Office Action issued in CN201511017160.8, dated Mar. 14, 2018, 6 pages.
Third Chinese Office Action issued in CN201511017160.8, dated Sep. 17, 2018, 11 pages.
Fourth Chinese Office Action issued in CN201511017160.8, dated Apr. 10, 2019, 4 pages.

* cited by examiner

LIGHT SOURCE APPARATUS AND METHOD OF MANUFACTURING THE SAME

CROSS-REFERENCE TO RELATED APPLICATIONS

This application is based upon and claims the priority of PCT patent application No. PCT/CN2016/112700 filed on Dec. 28, 2016 which claims the priority of Chinese Patent Application No. 201511017160.8 filed on Dec. 29, 2015 and Chinese Patent Application No. 201521126851.7 filed on Dec. 29, 2015, the entire contents of all of which are hereby incorporated by reference herein for all purposes.

TECHNICAL FIELD

The present disclosure relates to the technical field of illumination, in particular to a light source apparatus and a method of manufacturing the light source apparatus.

BACKGROUND

With the development of lighting technology, the illumination device has become a necessary component in people's lives. An illumination device generally includes a housing, at least two luminescent units fixed on the housing, and a power supply configured to supply power for the luminescent units. The luminescent unit may emit illuminating light to illuminate a target area after acquiring required power from the power supply.

SUMMARY

Examples of the present disclosure provide a light source apparatus and a method of manufacturing the light source apparatus.

Examples of the present disclosure provide a light source apparatus. The light source apparatus may include a luminescent component including a substrate and at least two luminescent units disposed on the substrate, the at least two luminescent units being arranged along a circular ring; and a light distribution component include an optical element provided with an annular lens or a transparent mask and a mounting part encircling the annular lens or the transparent mask and being connected with the optical element and the substrate, the lens or the transparent mask receiving emergent light of the at least two luminescent units and emitting the light after light distribution; and where the mounting part is bonded to the substrate and is configured to fix the optical element above the at least two luminescent units so as to adjust illuminating light emitted by the luminescent units through the optical element.

Examples of the disclosure provide a method of manufacturing a light source apparatus. The method may include providing a luminescent component comprising a substrate and at least two luminescent units disposed on the substrate, where the at least two luminescent units are arranged along a circular ring; and providing a light distribution component comprising an optical element provided with an annular lens or a transparent mask and a mounting part encircling the annular lens or the transparent mask and being connected with the optical element and the substrate, where the lens or the transparent mask receive emergent light of the at least two luminescent units and emitting the light after light distribution, and the mounting part is bonded to the substrate and is configured to fix the optical element above the at least two luminescent units so as to adjust illuminating light emitted by the luminescent units through the optical element.

It is to be understood that both the foregoing general description and the following detailed description are exemplary only and are not restrictive of the present disclosure.

BRIEF DESCRIPTION OF THE DRAWINGS

For more clear understanding of the technical proposals in the examples of the present disclosure, simple description will be given below to the accompanying drawings required to be used in the description of the examples. The accompanying drawings described below are only some examples specified in the present disclosure, and other accompanying drawings may also be obtained by those skilled in the art on the basis of the accompanying drawings without creative efforts.

Figure 1:
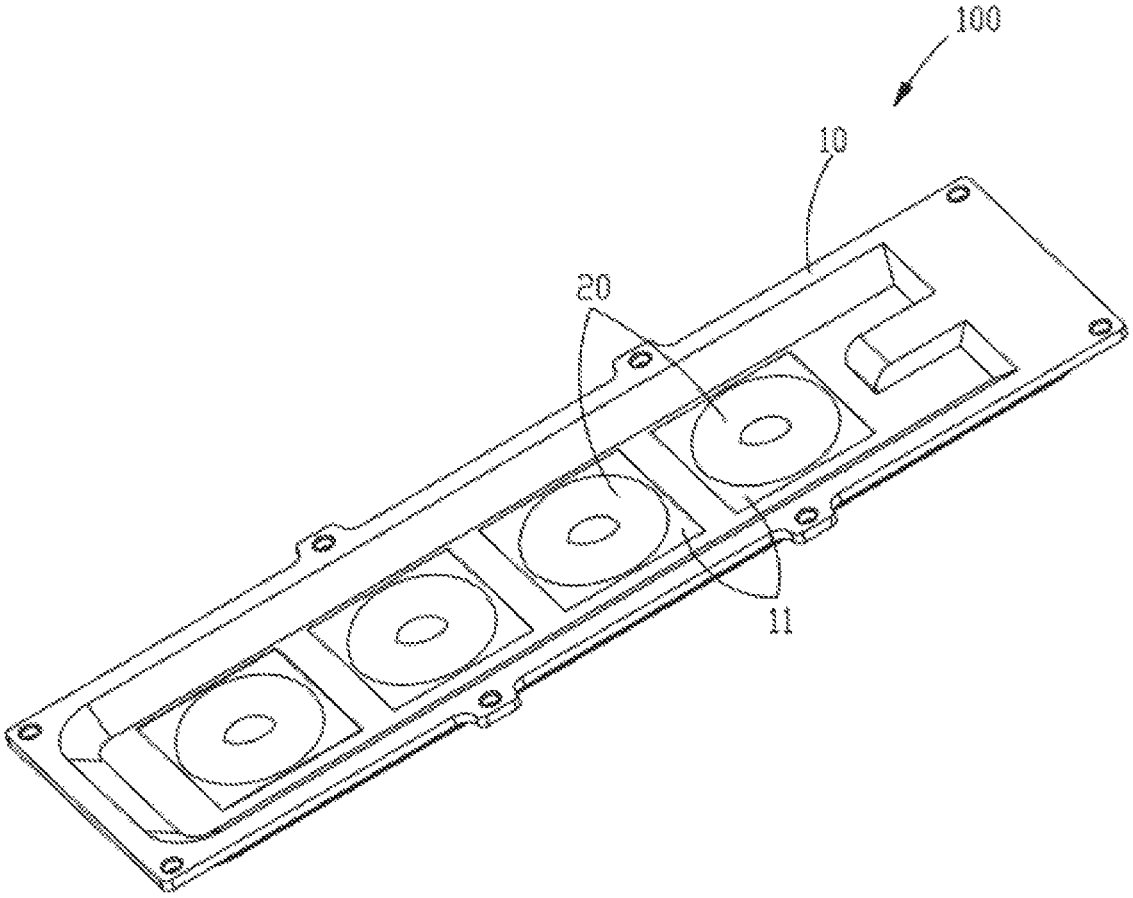
FIG. 1 is a perspective view of an illumination device provided by the example of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Examples of the present disclosure provide a light source module and an illumination device.

For better understanding of the technical proposals in the present disclosure, clear and complete description will be give below to the technical proposals in the examples of the present disclosure with reference to the accompanying drawings in the examples of the present disclosure. The examples are only partial examples of the present disclosure but not all the examples. All the other examples obtained by those skilled in the art on the basis of the examples of the present disclosure without creative efforts shall fall within the scope of protection of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

In the illumination device, as the luminescent units are undetachable and the number of the luminescent units also cannot be adjusted, when the lighting environment changes, an illumination device provided with luminescent units of corresponding number may be repurchased. Thus, the illumination device may not be able to adapt to a variety of lighting environments. The present disclosure provides a light source module and an illumination device for solving the above problem. Detailed description will be given below to the light source module and the illumination device with reference to the accompanying drawings.

As illustrated in FIG. 1, an illumination device 100 comprises a housing 10, light source modules 20 and a power supply module (not shown in the figure)

The housing 10 may be made from hard materials such as metal and plastics. Subsequently, the housing 10 can be mounted at an area such as the wall surface or the ceiling by various means such as fasteners and screws, so that a target area can be illuminated.

The illumination device 100 may be a tube spotlight, a lamp board, a dome lamp, a ceiling light, a car light or other types of common lamps in the industry. The illumination device 100 can be converted into a lamp of corresponding type by only adaptive adjustment of the shape of the housing 10. No further description will be given here.

No matter the illumination device 100 adopts any one of the tube spotlight, the lamp board, the dome lamp, the ceiling light or the car light, at least one storage bin 11 can be disposed in the housing 10 of the illumination device 100. The storage bin 11 is configured to accommodate the light source module 20. The shape of the storage bin 11 is preset according to the shape of the light source module 20. For instance, when the shape of the light source module 20 is square, the storage bin 11 is also set to be in the shape of a square opening. No further description will be given here.

Taking a lamp board as an example, a plurality of storage bins 11 arranged in an array may be disposed in an area provided with luminous sources in the conventional lamp board, and subsequently, the light source modules 20 are mounted in the storage bins 11.

The number of the storage bins 11 may be adjusted according to the size of the housing 10. For instance, when the illumination device 100 is taken as a car light, a small number of storage bins 11 may be set, so as to ensure that the size of the illumination device 100 will not be too large, and hence the aesthetic property of the car light will not be damaged. Conversely, when the illumination device 100 is taken as a lamp board, a large number of storage bins 11 may be set, so as to ensure the lighting strength of the lamp board.

The arrangement of the storage bins 11 may also be preset according to the lighting requirement of the illumination device 100. For instance, the storage bins may be disposed on the same straight line and may also be respectively disposed on a plurality of straight lines. No further description will be given here.

The number of the light source modules 20 is also preset according to the lighting requirement, as long as the number of the light source modules 20 does not exceed the number of the storage bins 11.

In the example of the present disclosure, the number of the storage bins 11 is set to be 4, and the storage bins 11 are disposed on the same straight line. The number of the light source modules 20 is also 4, and the light source modules 20 are mounted in the storage bins 11 in one-to-one correspondence. Of course, the number of the light source modules 20 may also be set to be other values less than 4. No further description will be given here.

The power supply module includes mains connections (not shown in the figure) extended into the storage bins 11. The mains connection may be electrically connected with the light source module 20 after the light source module 20 is mounted in the storage bin 11, so the light source module 20 can be electrically connected with the power supply module and then acquires required power from the power supply module.

The power connector may adopt plug type and may also adopt contact type, as long as the light source module 20 can be conveniently electrically connected with the power supply module after being mounted in the storage bin 11. No further description will be given here.

The power supply module may be alternating current (AC) and may also be a direct current (DC) battery pack. If the power supply module is AC, the power supply module is embodied as a plug electrically connected with the power connectors in the storage bins 11. If the power supply module is a DC battery pack, the power supply module is embodied as a battery pack detachably mounted on the housing 10 or a battery pack integrated onto the housing 10, electrically connected with the power connectors in the storage bins 11. The battery pack may be a battery pack customized for the illumination device and may also be a battery pack on other tools, e.g., an electric tool.

The power supply module further may include a protection circuit with functions such as overvoltage protection and overcurrent protection and an output management circuit with voltage and current management, etc. No further description will be given here.

In summary, in the illumination device 100 provided by the example of the present disclosure, when the lighting environment changes, the number of the mounted light source modules 20 may be directly adjusted by the disassembly or assembly of the light source modules 20, and an illumination device with luminescent units of corresponding number is not required to be repurchased, so the illumination device can be adapted to a variety of lighting environments.

Figure 2:
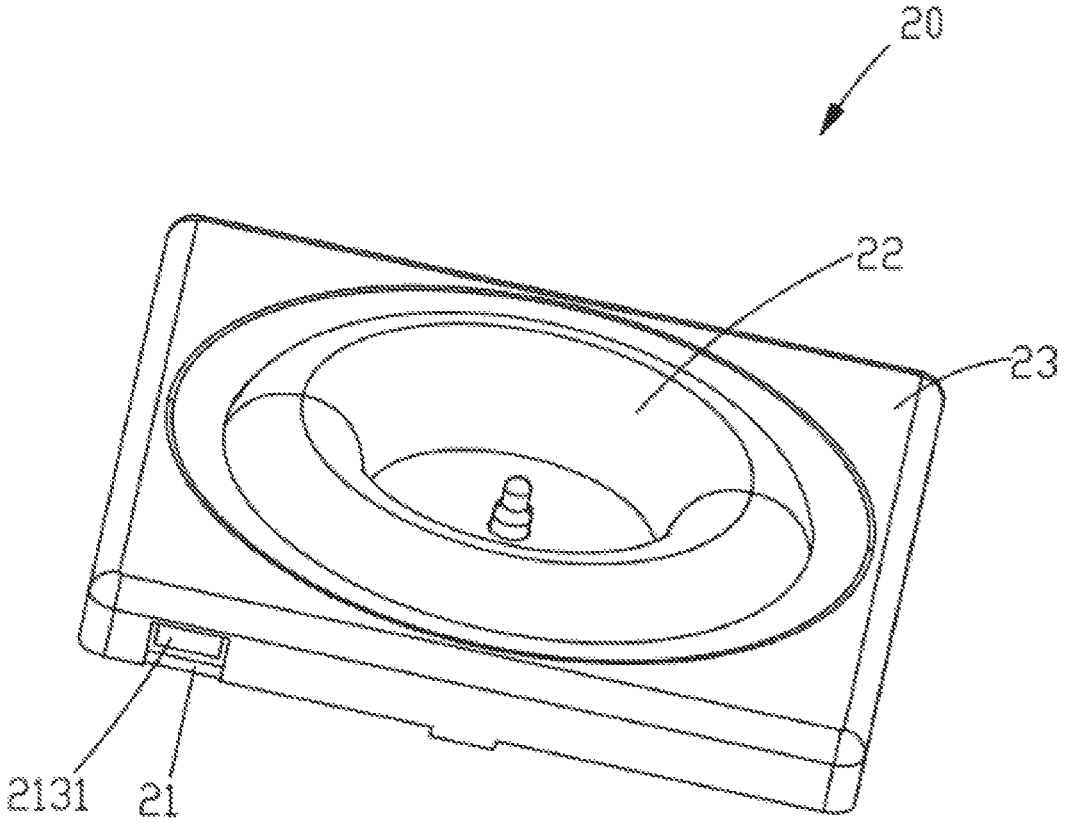
FIG. 2 is a perspective view of a light source module in the example present disclosure.

With reference to FIG. 2, the light source module 20 is an independent module and can be conveniently mounted in the storage bin 11 or disassembled from the storage bin 11.

The shape and the size of the light source module 20 may be standardized. For instance, the light source module may be set to be a square with the thickness of less than 10 mm. The shape of the storage bin 11 cooperated with the light source module 20 is also designed to be standardized. Thus, the light source module 20 of this type may be applied in various types of illumination devices, as long as the shape and the size of the storage bin 11 comply with standards.

Figure 3:
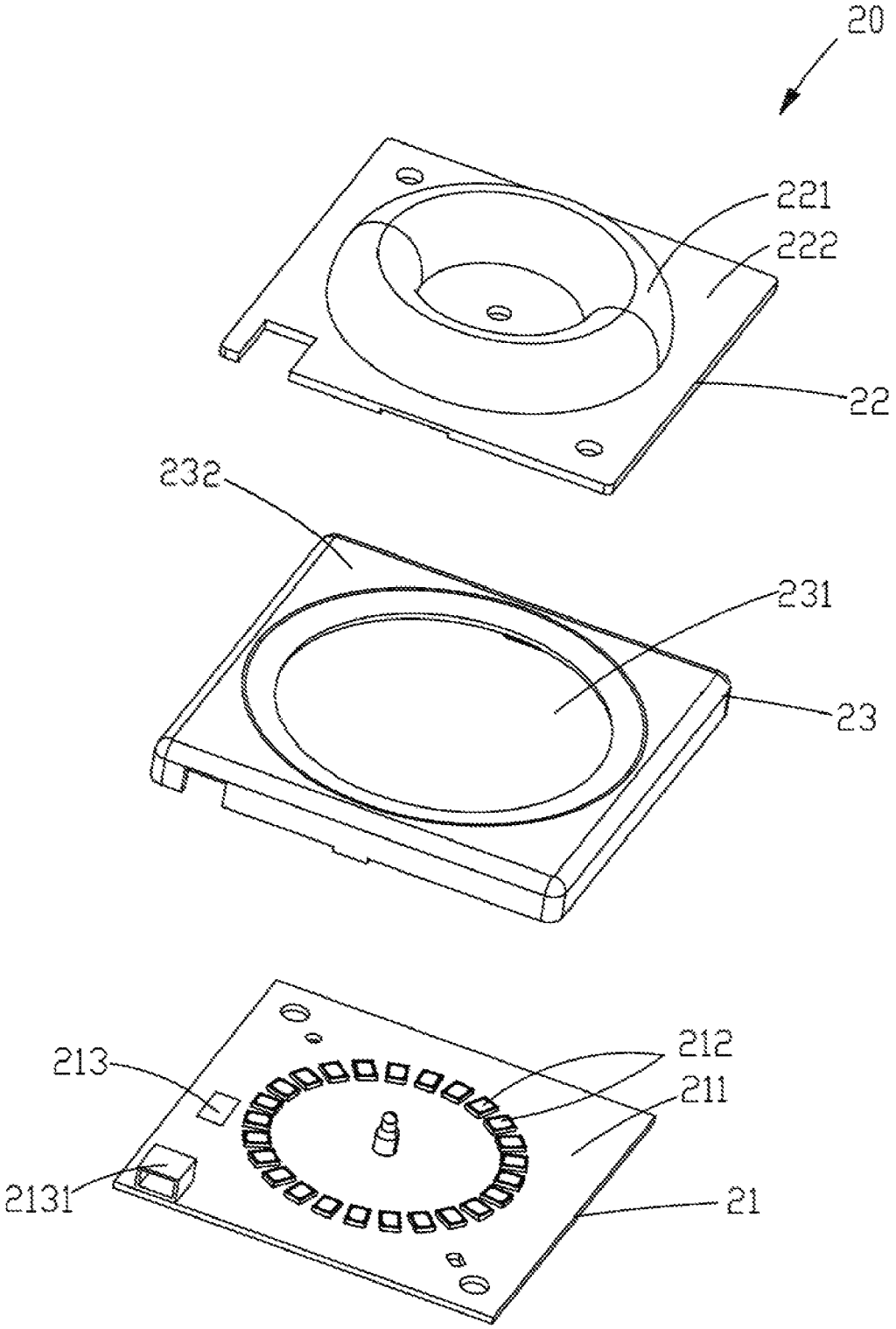
FIG. 3 is an exploded view of the light source module in the example of the present disclosure.

With reference to FIG. 3, the light source module 20 includes a luminescent component 21 and a light distribution component 22.

The luminescent component 21 includes a substrate 211 and at least two luminescent units 212 disposed on the substrate 211. The luminescent unit 212 may be a light-emitting diode (LED) light source, an incandescent lamp, a TL light source and other types.

The substrate 211 may be a printed circuit board (PCB) or a flexible circuit board. The shape of the substrate 211 is set according to the shape of the light source module 20. For instance, the substrate may be set to be a rectangular or circular flat sheet. No further description will be given here.

The luminescent units 212 are annularly distributed on the substrate 211, namely all the luminescent units 212 are disposed on a circular ring of the same circle. The luminescent units 212 may be uniformly distributed and may also be unevenly distributed.

The luminescent units 212 include cool color luminescent units and warm color luminescent units. The cool color luminescent unit and the warm color luminescent unit are respectively configured to emit cool-tone white light and warm-tone white light.

Of course, the cool color luminescent unit and the warm color luminescent unit may also be configured to emit cool light and warm light of other colors. No further description will be given here.

The cool color luminescent units and the warm color luminescent units may be set to be alternately arranged one by one (may also be arranged in a half-and-half manner), namely the warm color luminescent units are respectively disposed on both sides of any cool color luminescent unit and the cool color luminescent units are respectively disposed on both sides of any warm color luminescent unit. Of course, the cool color luminescent units and the warm color luminescent units may also be arranged in a half-and-half manner or arranged according to user demands. No further description will be given here.

The luminescent component 21 further includes a drive unit 213 disposed on the substrate 211. The drive unit 213 is electrically connected with the luminescent units 212 and configured to adjust the current provided for the luminescent units 212, so as to ensure the normal operation of the luminescent units 212.

The drive unit 213 includes an external interface 2131 cooperated with the power connector of the power supply module. After the light source module 21 is mounted in the storage bin 11, the power connector of the power supply module may be inserted into the external interface 2131, so that the light source module 21 can be electrically connected with the power supply module.

As the drive unit 213 includes the external interface 2131 capable of being adapted with the power supply module, when the number of the light source modules 20 may be adjusted, the number of the light source modules 20 can be rapidly increased, and the electrical connection between the light source module 20 and the power supply module can be created. Meanwhile, the light source module 20 can be rapidly disassembled, and the electrical connection between the light source module 20 and the power supply module can be cut off.

The light distribution component 22 is configured to adjust the illuminated light emitted by the luminescent component 21 and includes an optical element 221 and a mounting part 222. The optical element 221 and the mounting part 222 may be integrally formed or assembled in a split type.

The optical element 221 includes an annular lens or a transparent mask. The annular lens may be made from transparent materials. The transparent mask may be made from materials with flood characteristic or a condensing lens. Whether the annular lens or the transparent mask is specifically adopted may be selected according to the application environment of the illumination device. No further description will be given here.

In the example of the present disclosure, the illumination angle of the illuminated light emitted by the luminescent units 212 is diffused or converged by adjustment of the shape of the optical element 221. For instance, the illumination angle of the illuminated light may be set to be 30°, 60°, 90°, 130° or any other angle. Flow to adjust the shape of the optical element 221 to obtain the preset illumination angle is technology well-known by those skilled in the art. No further description will be given here.

The mounting part 222 is connected with the optical element 221 and the substrate 211 and is specifically configured to fix the optical element 221 above the luminescent unit 212, so as to ensure that the illuminated light emitted by the luminescent unit 212 can only be projected towards the target area after processed by the optical element 221.

In the example of the present disclosure, the optical element 221 is an annular lens, and the mounting part 222 encircles the optical element 221 and can be detachably mounted on the substrate 211 by fasteners, screws or other means, so that the optical element 221 can disposed above the luminescent unit 212.

Taking the integral forming of the optical element 221 and the mounting part 222 as an example, the optical element 221 is extended from a surface of the mounting part 222 and provided with an annular accommodating cavity (not marked) on a side facing the luminescent unit 212, so as to accommodate the luminescent units 212 through the accommodating cavity. The annular lens 221 is set to be hyperboloid or TIR configuration so as to extend or collimate the illuminated light.

The light source module 20 further includes a protective cover 23 for covering the light distribution component 22. The protective cover 23 is provided with an opening 231. The optical element 221 runs through the opening 231. Thus, the illuminated light emitted by the luminescent unit 212 can arrive at the target area after running through the optical element 221.

The shape of the protective cover 23 is close to the shape of the substrate 211. The protective cover is configured to protect the light distribution component 22 and the luminescent component 21 from being damaged by external collision. A top surface 232 of the protective cover 23 is bonded with the mounting part 222, or the top surface 232 of the protective cover 23 abuts against the mounting part 222. The protective cover 23 is detachably connected with the substrate 211, for instance, may be connected with the substrate 211 by fasteners, screws or other means. No further description will be given here.

The external interface 2131 in the luminescent component 21 runs through the protective cover 23, so as to provide convenience for the adapting and connection of the external interface 2131 and the power connector in the power supply module.

In the light source module 20 and the illumination device 100 employing the light source module 20, provided by the example of the present disclosure, the light source modules 20 taken as independent modules are mounted in the illumination device 100. When the lighting environment changes, the number of the light source modules 20 in the illumination device may be directly adjusted and an illumination device is not required to be repurchased, so the illumination device can be adapted to a variety of lighting environments.

Examples of the present disclosure provide a light source module and an illumination device, which are used for solving the problem that the illumination device cannot be adapted to a variety of lighting environments.

Examples of the present disclosure provide a light source module, comprising:

a luminescent component including a substrate and at least two luminescent units disposed on the substrate, the at least two luminescent units being arranged along a circular ring; and a light distribution component including an optical element provided with an annular lens or a transparent mask and a mounting part encircling the annular lens or the transparent mask and being connected with the optical element and the substrate, the lens or the transparent mask receiving emergent light of the at least two luminescent units and emitting the light after light distribution; and the mounting part being bonded to the substrate and configured to fix the optical element above the at least two luminescent units, so as to adjust illuminating light emitted by the luminescent units through the optical element.

Preferably, the at least two luminescent units include cool color luminescent units and warm color luminescent units.

Preferably, the cool color luminescent units and the warm color luminescent units are alternately arranged one by one.

Preferably, the optical element is configured to allow the illuminating light emitted by the luminescent units to converge or diffuse.

Preferably, the optical element is configured to allow an illumination angle of the illuminating light emitted by the luminescent units to be 30°, 60°, 90°, or 130°.

Preferably, the light source module comprises a protective cover for covering the light distribution component; and the protective cover includes an opening which allows the optical element to run through, and is detachably connected with the substrate.

Preferably, a top surface of the protective cover is bonded with the mounting part, or the top surface of the protective cover abuts against the mounting part and is detachably connected with the substrate.

Preferably, the light source module further comprises a drive unit disposed on the substrate; and the drive unit is electrically connected with the luminescent units and configured to adjust current provided for the luminescent units.

Preferably, the drive unit includes an external interface configured to be connected with a power supply module; and the power supply module is connected with the external interface in a pluggable manner.

Preferably, the annular lens is configured to be hyperboloid or total internal reflection (TIR) configuration so as to extend or collimate the illuminating light.

Examples of the disclosure provide an illumination device, comprising:

a housing;

a power supply module mounted on the housing; and at least one storage bin disposed on the housing and configured to accommodate the light source module as mentioned above and allow the accommodated light source module to be electrically connected with the power supply module.

Preferably, a number of the storage bins is at least two; a number of the light source modules is two; the light source modules are detachably accommodated into the storage bins; and the two light source modules are respectively electrically connected with the power supply module which is at least partially extended into the storage bins.

Preferably, the power supply module is connected with an external interface of the light source modules in a pluggable manner.

Examples of the disclosure provide an illumination device, comprising:

a housing;

a power supply module mounted on the housing;

at least one storage bin disposed on the housing; and the light source module as mentioned above, wherein the light source module is disposed in the storage bin and electrically connected with the power supply module.

In the light source module and the illumination device employing the light source module, provided by the example of the present disclosure, the light source modules taken as independent modules are mounted in the illumination device. When the lighting environment changes, the number of the light source modules in the illumination device can be directly adjusted and the illumination device is not required to be repurchased, so the illumination device can be adapted to a variety of lighting environments.

All the examples in the description are described in a progressive manner. Same or similar parts among the examples refer to each other. Each example emphasizes those different from other examples. In particular, as system examples are basically similar to method examples, the system examples are simply described, and relevant parts refer to partial description of the method examples.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that may be executed by one or more processors.

The foregoing is only the examples of the present disclosure and not intended to limit the present disclosure. Various modifications and changes may be made to the present disclosure by those skilled in the art. Any modification, equivalent replacement, improvement or the like made within the spirit and the principle of the present disclosure shall fall within the scope of protection of the claims of the present disclosure.

What is claimed is:

1. A light source apparatus, comprising:

a luminescent component comprising a substrate and at least two luminescent units disposed on the substrate, two adjacent luminescent units of the at least two luminescent units are arranged along a circular ring at an orientation with two opposite sides of each of the at least two luminescent units aligned to form an inner circumference and an outer circumference of the circular ring; and a light distribution component comprising an optical element provided with an annular lens and a mounting part encircling the annular lens and being connected with the optical element and the substrate, wherein the optical element extends from a surface of the mounting part and is arranged along the circumference of the circular ring to accommodate the at least two luminescent units, the lens receives emergent light of the at least two luminescent units and emits the light after light distribution;

the annular lens includes an inner circumference and an outer circumference, the annular lens extending from the surface of the mounting part at both the inner circumference and the outer circumference;

the mounting part is bonded to the substrate and is configured to fix the optical element above the at least two luminescent units so as to adjust illuminating light emitted by the luminescent units through the optical element; and a protective cover for covering the light distribution component, wherein the protective cover comprises an opening to allow the optical element to run through, the protective cover is detachably connected with the substrate, and the optical element is configured to run through a top surface of the protective cover.

2. The light source apparatus according to claim 1, wherein the at least two luminescent units comprise cool color luminescent units and warm color luminescent units.

3. The light source apparatus according to claim 2, wherein the cool color luminescent units and the warm color luminescent units are alternately arranged with one adjacent to another.

4. The light source apparatus according to claim 1, wherein the optical element is configured to allow the illuminating light emitted by the luminescent units to converge or diffuse.

5. The light source apparatus according to claim 1, wherein the top surface of the protective cover is bonded with the mounting part, or the top surface of the protective cover abuts against the mounting part and is detachably connected with the substrate.

6. The light source apparatus according to claim 1, further comprising a drive unit disposed on the substrate, wherein the drive unit is electrically connected with the luminescent units and is configured to adjust current provided for the luminescent units.

7. The light source apparatus according to claim 6, wherein the drive unit comprises an external interface configured to be connected with a power supply; and the power supply is connected with the external interface in a pluggable manner.

8. An illumination device, comprising:

a housing;

a power supply mounted on the housing; and the light source apparatus according to claim 1, wherein the light source apparatus is electrically connected with the power supply.

9. The illumination device according to claim 8, wherein a number of storage bins is at least two; a number of the light source apparatuses is two; the light source apparatuses are detachably accommodated into the storage bins; and the two light source apparatuses are respectively electrically connected with the power supply which is at least partially extended into the storage bins.

10. The illumination device according to claim 9, wherein the power supply is connected with an external interface of the light source apparatuses in a pluggable manner.

11. An illumination device, comprising:

a housing;

a power supply mounted on the housing;

at least one storage bin disposed on the housing; and the light source apparatus according to claim 1, wherein the light source apparatus is disposed in the storage bin and electrically connected with the power supply.

12. A method of manufacturing a light source apparatus, comprising:

providing a luminescent component comprising a substrate and at least two luminescent units disposed on the substrate, wherein two adjacent luminescent units of the at least two luminescent units are arranged along a circular ring at an orientation with two opposite sides of each of the at least two luminescent units aligned to form an inner circumference and an outer circumference of the circular ring; and providing a light distribution component comprising an optical element provided with an annular lens and a mounting part encircling the annular lens and being connected with the optical element and the substrate, wherein the optical element extends from a surface of the mounting part and is arranged along the circumference of the circular ring to accommodate the at least two luminescent units, the lens receives emergent light of the at least two luminescent units and emits the light after light distribution;

the annular lens includes an inner circumference and an outer circumference, the annular lens extending from the surface of the mounting part at both the inner circumference and the outer circumference;

the mounting part is bonded to the substrate and is configured to fix the optical element above the at least two luminescent units so as to adjust illuminating light emitted by the luminescent units through the optical element; and a protective cover for covering the light distribution component, wherein the protective cover comprises an opening to allow the optical element to run through, the protective cover is detachably connected with the substrate, and the optical element is configured to run through a top surface of the protective cover.

13. The light source apparatus according to claim 1, wherein the optical element is configured to allow an illumination angle of the illuminating light emitted by the luminescent units to be 30°, 60°, 90°, or 130°, and the annular lens is configured to be total internal reflection (TIR) configuration so as to extend or collimate the illuminating light.

14. The illumination device according to claim 9, wherein the number of the light source apparatuses is capable of being adjusted by assembling or dissembling in response to changes of lighting environments, and the light source apparatuses, when assembled, are mounted in the storage bins in one-to-one correspondence.

* * * * *